US005330033A

United States Patent [19]

Tatumi

[11] Patent Number: 5,330,033

[45] Date of Patent: Jul. 19, 1994

[54] LIFT DEVICE COMPRISING STRAP-LIKE RAIL AND BEARINGS FITTED TO HELICAL STRAP-LIKE RAIL

[76] Inventor: Shigezou Tatumi, No. 33-6 Asahimachi 2-chome, Nara-shi, Nara 631, Japan

[21] Appl. No.: 971,771

[22] PCT Filed: Aug. 15, 1991

[86] PCT No.: PCT/JP91/01085

§ 371 Date: Feb. 12, 1993

§ 102(e) Date: Feb. 12, 1993

[87] PCT Pub. No.: WO92/03369

PCT Pub. Date: Mar. 5, 1992

[30] Foreign Application Priority Data

Aug. 15, 1990 [JP] Japan ..... 2-216201

[51] Int. Cl.[5] ..... B66B 7/02

[52] U.S. Cl. ..... 187/95; 187/24; 104/127

[58] Field of Search ..... 187/95, 9 E, 24, 25; 104/127, 128, 129, 138.1

[56] References Cited

U.S. PATENT DOCUMENTS

| | | | |
|---|---|---|---|
| 2,066 | 9/1865 | Miller | 187/25 |
| 62,788 | 3/1867 | Van Emon | 187/25 |
| 374,442 | 12/1887 | Backman | 187/25 |
| 698,738 | 4/1902 | Roney | 187/95 |
| 765,348 | 7/1904 | Vogel | 187/25 |
| 3,188,917 | 6/1965 | Quayle | 187/9 E X |
| 3,399,789 | 9/1968 | Forst | 187/24 X |
| 4,848,520 | 7/1989 | Gibel et al. | 187/9 E |
| 5,125,346 | 6/1992 | Piepers | 187/95 X |

FOREIGN PATENT DOCUMENTS

| | | | |
|---|---|---|---|
| 1053549 | 2/1954 | France | 187/25 X |
| 1096296 | 6/1955 | France | 187/9 E X |
| 57-77185 | 5/1982 | Japan . | |
| 1-81786 | 3/1989 | Japan . | |
| 523015 | 8/1976 | U.S.S.R. | 187/25 X |
| 853058 | 8/1981 | U.S.S.R. | 187/24 X |
| 998281 | 2/1983 | U.S.S.R. | 187/24 X |
| 658022 | 10/1951 | United Kingdom | 187/25 X |

*Primary Examiner*—Robert P. Olszewski
*Assistant Examiner*—Dean A. Reichard
*Attorney, Agent, or Firm*—Browdy and Neimark

[57] ABSTRACT

A lift device having shielded bearings and a strap-like rail that are designed to screw fit in each other. The shielded bearings are mounted in a circumferential thread fashion at a proper pitch on at least three pillars provided inside an outer shell cylinder. A short cylinder has a strap-like rail curvedly wound around its outer circumference so as to screw fit into the bearings. The short cylinder is rotated by a motor mounted on a frame to support the short cylinder at a vertically central position by thrust bearings. Side iron plates are provided on the frame which surround sides of the pillars and the shielded bearings. The iron plates form a cam groove which is slidably engaged on the pillars to stop rotation of the frame around the pillars when the frame moves vertically with the short cylinder, as well as maintaining the short cylinder at the vertically central position.

3 Claims, 4 Drawing Sheets

LIFT DEVICE COMPRISING STRAP-LIKE RAIL AND BEARINGS FITTED TO HELICAL STRAP-LIKE RAIL

TECHNICAL FIELD

The present invention relates to a lift that is formed into a unit based on an idea in which a lift mechanism is attained by rotating a bolt which is in thread engagement so as to raise and/or lower it. This inevitably requires reduction in friction loss at the thread engagement portion. To achieve this, the female and male threading construction is enlarged to proper dimensions without any change in the other factors of the construction, in other words, a thread-like rail is mounted on one of the members, while bearings are mounted on the other member which are arranged in a thread-like fashion to be brought into engagement with the thread-like rail, so that the friction loss between threads can be eliminated. Moreover, not only a rotation stop means but also a power are provided on a lift cage that is to be raised and/or lowered, whereby a portion to be rotated that is connected thereto via thrust bearings is rotated.

PRIOR ART

Conventionally, a sliding device termed as a so-called ball screw has been known. The sliding device has a wide range of applications, such as an XY recorder in a measuring machine, and a feeding device for a machine tool. However, it is more or less impossible to use such a sliding device for a lift device as it is. In other words, the structure comprises a ball and a screw that are in smooth sliding engagement, and a lubricant used to lubricate the engagement is essentially required along the full sliding distance of the screw shaft portion, and therefore even if an expandable bellows are used as a protecting and dust proofing cover for the sliding device, or this is implemented by a solid telescopic cover, it is totally impossible to cover a long device such as a lift. Furthermore, although the shaft is usually rotated to drive the sliding device, deflection resulting from a manufacturing precision constitutes a cause for low rotation speed, and even if a motor is mounted on a nut side member, there is a limit to manufacturing a long shaft side member. The current technology of connecting a plurality of short shaft members to each other .is not accurate enough to produce such a long shaft, and hence no long shaft based upon that technology has been realized. Moreover, as to a method for supporting a lift cage, in order to adopt a two-end support instead of a one-end support, design strategies including synchronization of rotation are required. However, this serves only to complicate the structure and make it difficult to realize an ideal device.

DISCLOSURE OF THE INVENTION

The present invention provides a lift device characterized in that a large diameter cylinder properly dimensioned in terms of the rotation strength and load rigidity of bearings used is provided as an outer shell, that shielded bearings are mounted in such a manner that they are arranged along the inner surface of the outer shell in a female thread like fashion with a proper thread pitch, that a short cylinder is telescopically inserted within the shielded bearings with a proper gap provided therebetween, and that a male thread-like strap-like rail is wound around the outer circumference of the short cylinder with the same thread pitch as that of the shielded bearings so that the strap-like rail screw-fits into the root portion of the female threads of the large diameter cylinder as an outer shell, whereby a male and female thread engagement state is established so that the inner short cylinder is rotated to be raised and/or lowered, a driving motor being mounted on the lift cage so as to be integrated therewith, the integrated body being coupled to the short cylinder constituting a portion to be rotated via bearings, and side iron plates being provided on the lift cage side to prevent not only the rotation thereof but also the rolling of the portion to be rotated, so that they are brought into engagement with the bearings that are arranged in a thread-like fashion by making use of the bearings again, whereby the smoothness required for rotational, vertical motion is attained. Thus, the drawbacks mentioned in the previous paragraph are compensated for. In addition, the same function can be obtained, conversely to the above construction, by mounting a female thread-like strap rail on the inner surface of the outer shell cylinder and male thread-like shielded bearings on the outer surface of the inner short cylinder. However, with this construction, since it is difficult to replace a worn rail with a new one and obtain a good manufacturing accuracy, the application thereof is limited to an infrequently used one which will be described later. Furthermore, this idea can be developed to a construction in which a plurality of cylinders are inserted within the outer shell cylinder in a multi-thread-like, i.e. telescopic fashion in the order of size, whereby a multiplicity of cylinders that are inserted one within another at an initial stage are telescopically expanded so that the device can be used for a movable footstool.

BEST MODE FOR EMBODYING THE PRESENT INVENTION

The present invention will be described in detail with reference to the accompanying drawings.

Figure 1:
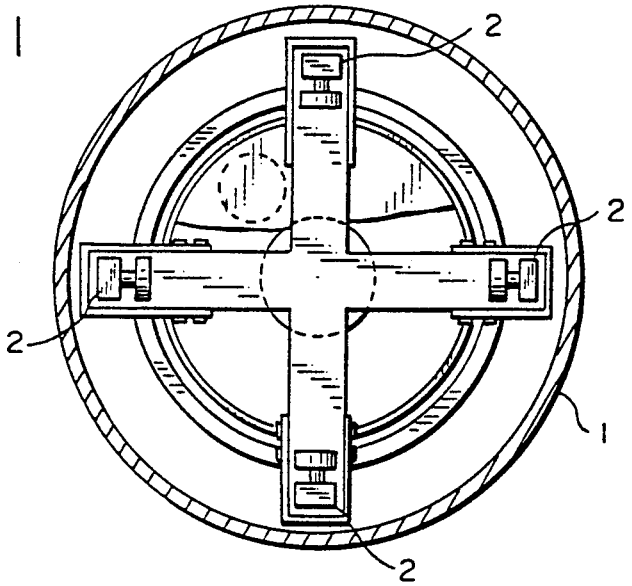
FIG. 1 is a plan view, partially cut-away, showing a construction in which four pillars are provided on the inner surface of an outer shell cylinder with bearing being mounted thereon in a thread-like fashion, and in which a short cylinder is provided inside the outer shell cylinder around which a strap-like rail is wound in a male thread-like fashion, FIG. 2 a partially cut-away perspective view of the above construction, FIG. 3 a partially cut-away perspective view of a construction that is opposite to the above, FIG. 4 a partially cut-away perspective view of an escape device having a lift cage provided so as to protrude outwardly for gravity-fall, and FIG. 5 a partially cut-away perspective view showing a multi-thread construction.

In FIG. 1, a frame 6 is set in which four pillars 2, 2, . . . , are provided along the inner circumferential surface of an outer shell cylinder 1 with a slight gap being provided therebetween, in which shielded bearings 3, 3, . . . , are arranged and mounted at a proper pitch in a circumferential thread-like fashion on each of the pillars, in which a short cylinder 5 having a strap-like rail 4 wound around the outer circumference thereof is thread inserted thereinto so as to come into thread engagement with the shielded bearings with a fine gap provided therebetween, and in which the short cylinder is supported at a vertically central position via the thrust bearings 13. Side iron plates 7, 7, . . . , are provided at the respective four pillar positions so as to embrace the bearings for each pillar from the sides with a slight gap being kept therebetween, which serves not only to maintain the short cylinder 5 at the central position with respect to an XY direction but also to stop the rotation of the frame 6 by bearing the reaction force generated by the rotational driving of the short cylinder 5 by means of a rotational driving motor 9 mounted integrally with a lift cage 8 set on the frame 6. A pinion gear 10 and a large gear 11 are mounted on the motor 9 shaft and the short cylinder 5, respectively, whereby the rotation of the motor is transmitted to the short cylinder 5. An outer door is provided at a position corresponding to a door 12 provided on the lift cage 8 between the pillars 2, 2 of the outer shell cylinder for entrance and exit.

Figure 4:
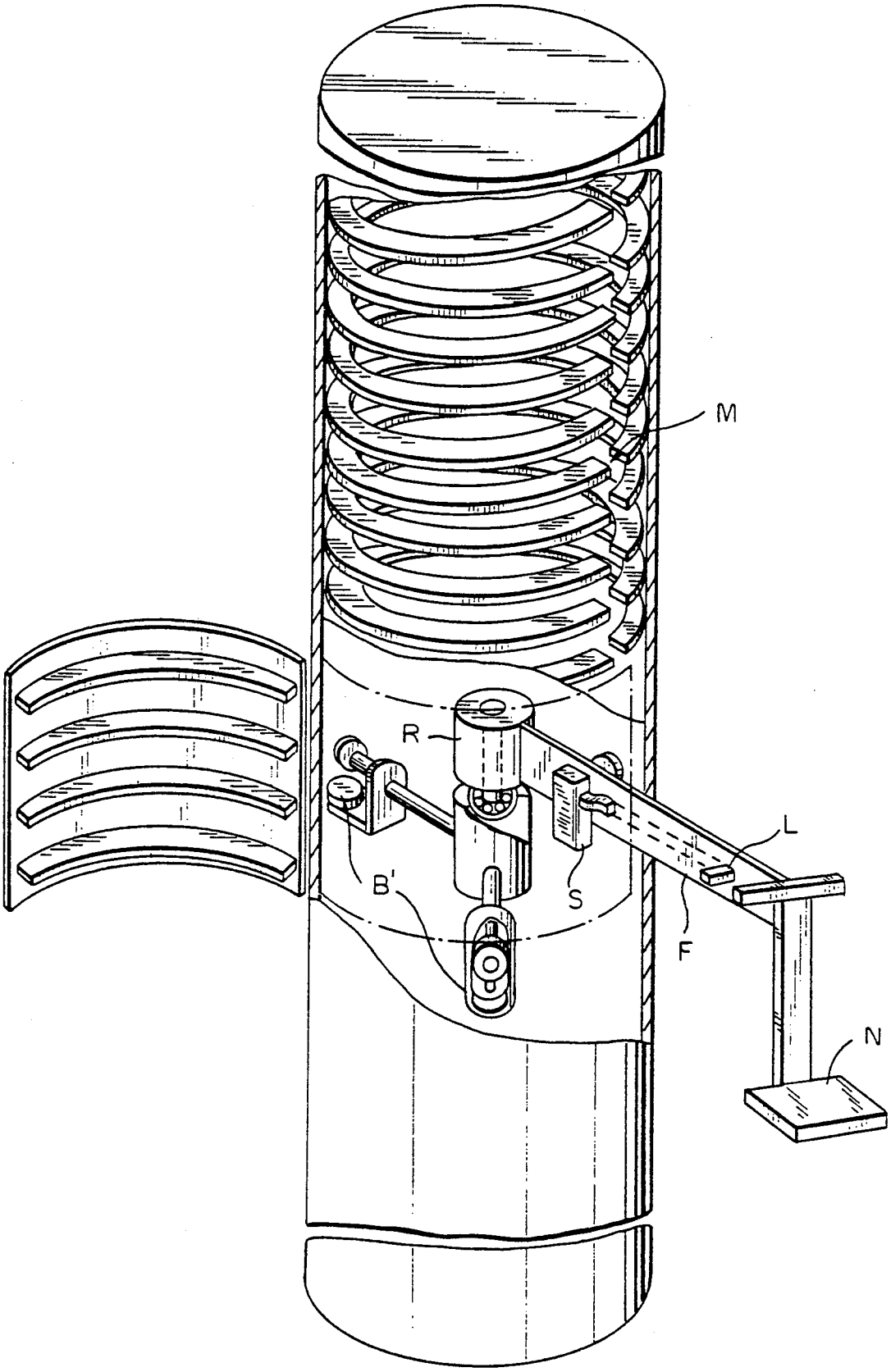

FIG. 4 shows a reverse construction in which opening grooves M are provided by slit cutting vertically the strap-like rail on the outer shell at proper positions so that a stay F is made to protrude from an inner spacer R connecting the rotational short cylinder to the bearings with a necessary carrier N being provided on the stay. There is provided no power so that a lowering device is simplified, enabling a number of lowering devices to be provided, and there are provided the outer shell cylinder, a brake shoe S, and a lever L for activating the brake shoe. Thus, the construction is illustrated as a lowering device for emergency escape. In addition, three small-diameter bearings B', B', B' mounted substantially horizontally on the outer circumference of the short cylinder at three positions thereof so as to thrust the inner circumference of the outer cylinder are used to maintain the central position. An outer door is hinged so as to constitute an entrance through which a rotational body can be inserted at any time. Preferably, a large number of lowering rotational devices are to be provided and they should be simple in construction so that anybody can carry the devices for entry and exit, and a rod-like device having bearings at ends thereof is desired.

Figure 2:
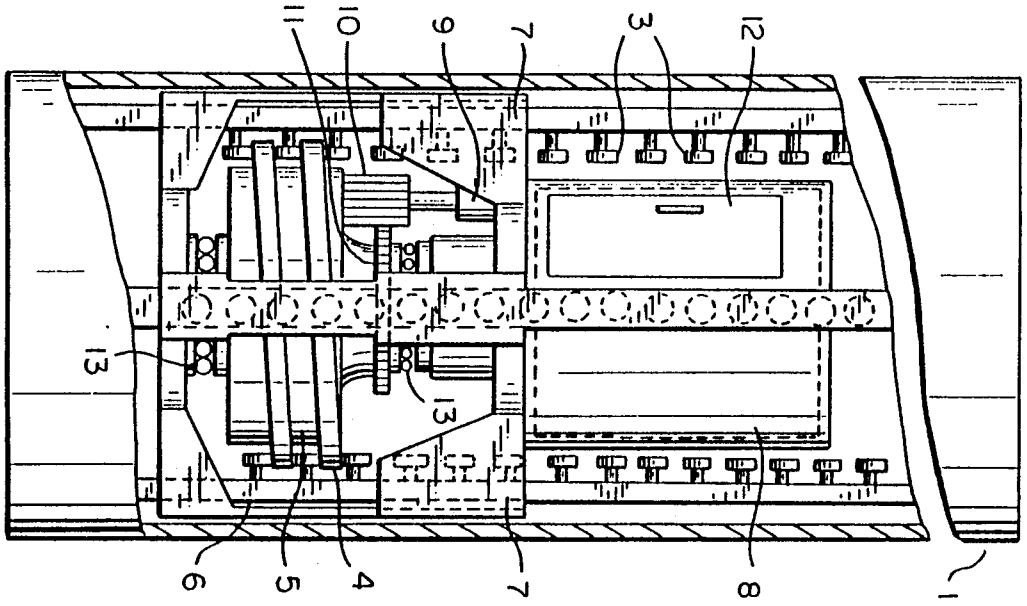
Figure 3:
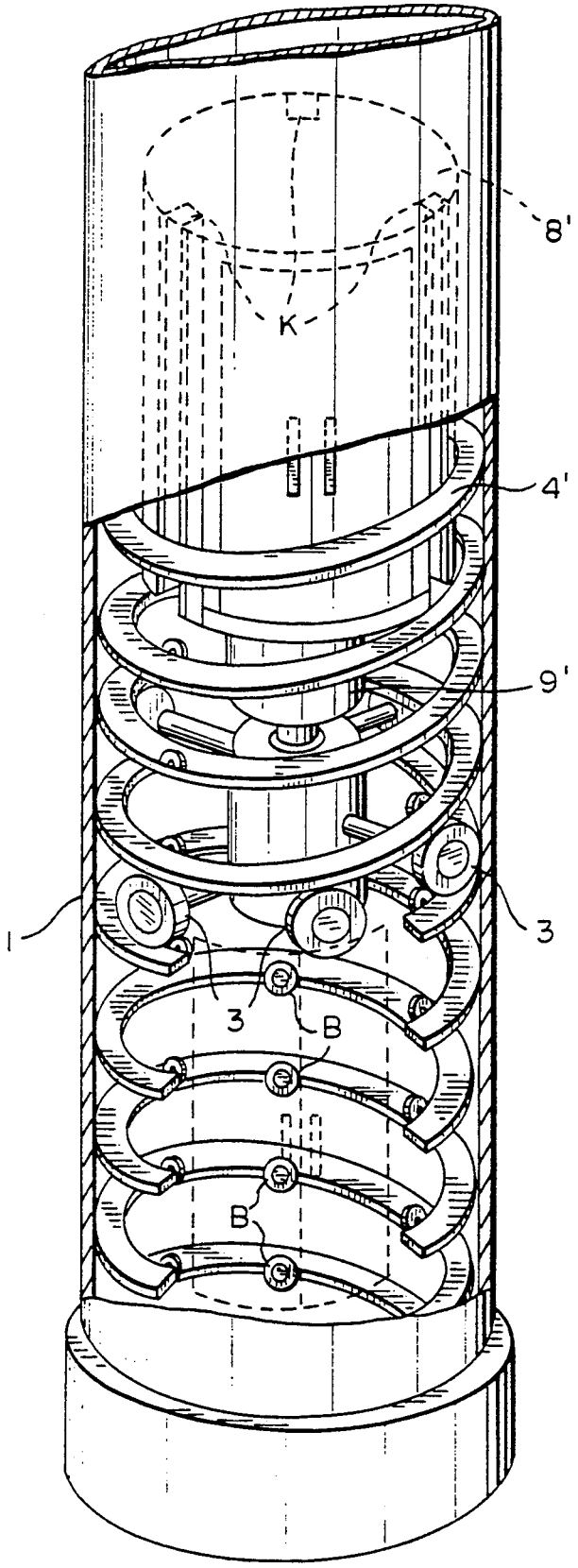
Figure 5:
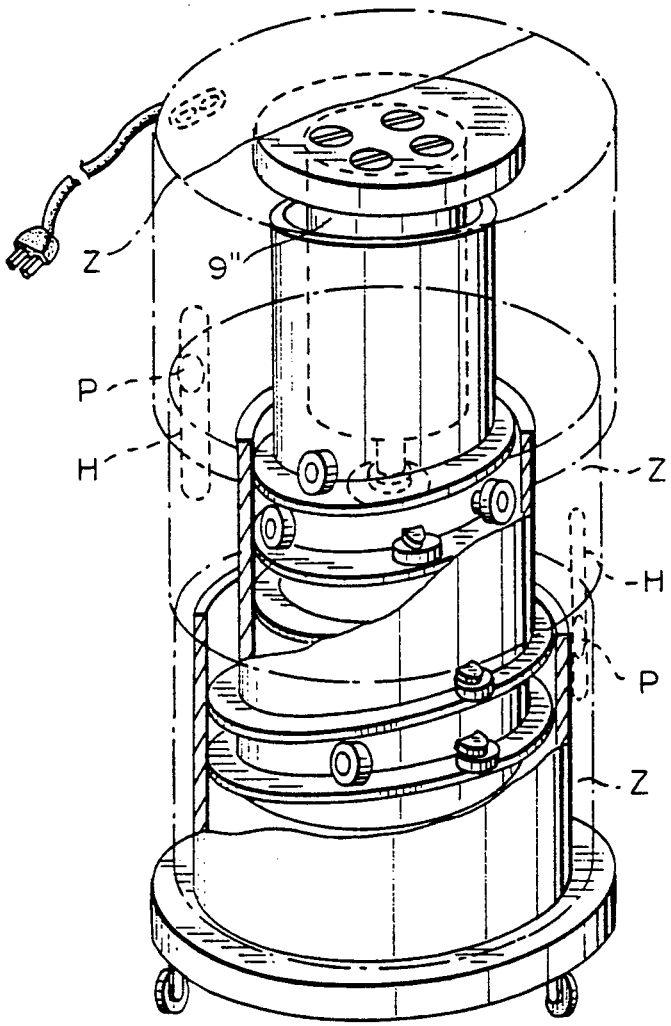

FIG. 5 shows a mechanism developed based on the ideas illustrated in FIGS. 1 and 2. In this mechanism, large and small cylinders are fitted one within another in a multi-thread fashion so that they protrude telescopically. A rotational driving motor 9 is mounted at the central position, and the back of the motor is fixed to the uppermost portion of a telescopic cover cylinder Z, Z, Z, (in this embodiment, three stages), which are expanded and contracted, or raised and lowered concentrically together with a rotation stop holding portion serving not only to stop coming-off but also to stop rotation by slit grooves H, H, H, and locking pins P, P, P, whereby rotation is prevented. Casters are mounted on this-structure to constitute a movable footstool, which is based on the development from the basic ideas.

Industrial Application:

Thus, the lift machanism according to the present invention is so safe that no maintenace and inspection is practically required, and can be adopted as a unit lift for home use, or outdoor use. The compact mechanical section allows the lift machanism to be used for a lift for every purpose. Moreover, as shown in FIGS. 1 and 2, the lift mechanism provides free entrance and exit. In addition, it is easy to fabricate and enables a pitch accuracy at the time of production to be easily obtained. Rails are provided on the short cylinder side so that they can easily be replaced when they get worn. As shown in FIG. 4, erection rigidity is maintained at the sacrifice of accuracy, and on top of that, it can be applied to a device exclusively used for lowering in which power in any form is not used and in which a plurality of simple rotational bodies can be used. Furthermore, as shown in FIG. 5, it is also applied to a footstool that can be used in storing and issuing articles in stores due to convenience resulting from the absence of pillars.

I claim:

1. A lift device comprising bearings and a strap-like rail that are designed to screw fit in each other, characterized in that shielded bearings are mounted in a circumferential thread fashion at a proper pitch on at least three pillars provided inside an outer shell cylinder, that a short cylinder is threadingly inserted into said outer shell cylinder around the outer circumference of which short cylinder a strap-like rail is curvedly wound so as to screw fit into said bearings, that said short cylinder is rotated by a motor mounted on a frame to support said short cylinder at a vertically central position via thrust bearings, and that side iron plates are provided on the frame surrounding sides of the pillars and the shielded bearings thereon with a slight gap being kept therebetween, said iron plates forming a cam groove slidably engaged on the pillars to stop rotation of said frame around said pillars when said frame moves vertically with said short cylinder, as well as maintaining said short cylinder at the vertically central position.

2. A lift device exclusively used for lowering comprising bearings and a strap-like rail that are designed to screw fit in each other, characterized by a construction in which the relationship between the mounting positions of the bearings and rail that are in thread engagement, wherein a strap-like rail and bearings are provided on an outer shell and a rotational inner cylinder, respectively, wherein a stay of an inner spacer that is bearing connected to the rotational inner cylinder is made to protrude from an open groove portion formed by vertically cutting said outer shell at proper positions thereof for acting as rotation stop means, wherein maintaining of the central position is attained by small-diameter bearings provided horizontally on the outer circumference of said rotational inner cylinder so as to thrust against the inner circumference of said outer shell, and wherein simple rotational bodies that can be inserted in a large number at any time are provided, with power being omitted.

3. (amended) A lift device comprising bearings and a strap-like rail that are designed to screw fit in each other, characterized in that a plurality of short cylinders are inserted concentrically inside an outer short cylinder in a telescopic fashion, that a strap-like rail and shielded bearings are arranged and set on inner and outer circumferential surfaces of the outer short cylinder and the short cylinders inserted therein respectively, so as to be brought into thread engagement with each other, that a motor on which rotation stop means is provided from the outside thereof is mounted at the centermost position thereof so as to sequentially rotate the short cylinders, whereby said short cylinders are caused to extend so as to be raised or lowered telescopically together with the rotation stop means which engages with said short cylinders and with said outer short cylinder for limiting rotation of said short cylinders with respect to said outer short cylinder.

* * * * *